US008201761B2

(12) United States Patent
Jensen

(10) Patent No.: US 8,201,761 B2
(45) Date of Patent: Jun. 19, 2012

(54) THICKNESS SENSOR BASED MOTOR CONTROLLER

(75) Inventor: Michael D. Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 471 days.

(21) Appl. No.: 12/348,420

(22) Filed: Jan. 5, 2009

(65) Prior Publication Data

US 2010/0170967 A1 Jul. 8, 2010

(51) Int. Cl.
*B02C 7/00* (2006.01)
*B02C 7/14* (2006.01)

(52) U.S. Cl. ..... 241/36; 241/101.3; 241/236

(58) Field of Classification Search ..... 241/25, 241/30, 36, 236, 101.3
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Nara et al. |
| 3,724,766 | A | 4/1973 | Bosland |
| 3,764,819 | A | 10/1973 | Muller |
| 3,785,230 | A | 1/1974 | Lokey |
| 3,829,850 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |
| 4,489,897 | A | 12/1984 | Turner |
| 4,495,456 | A | 1/1985 | Vercillo et al. |
| 4,497,478 | A | 2/1985 | Reschenhofer |
| 4,683,381 | A | 7/1987 | Dufoug |
| 4,707,704 | A | 11/1987 | Allen |
| 4,757,949 | A | 7/1988 | Horton |
| 4,814,632 | A | 3/1989 | Glaeser |
| 4,815,669 | A | 3/1989 | Fujii |
| 4,842,205 | A | 6/1989 | Araki |
| 4,889,291 | A | 12/1989 | Goldhammer et al. |

(Continued)

FOREIGN PATENT DOCUMENTS

| | | |
|---|---|---|
| DE | 3313232 | 10/1984 |

(Continued)

OTHER PUBLICATIONS

International Search Report and Written Opinion for PCT International Patent Application No. PCT/US2009/069426, dated Aug. 23, 2010.

(Continued)

*Primary Examiner* — David J. Walczak
*Assistant Examiner* — Jennifer C Chiang
(74) *Attorney, Agent, or Firm* — Pillsbury Winthrop Shaw Pittman LLP

(57) ABSTRACT

A shredder includes a housing having a throat for receiving at least one article to be shredded, a shredder mechanism received in the housing and including an electrically powered motor and cutter elements, a detector configured to detect a thickness of the at least one article being received by the throat; and a controller coupled to the motor and the detector. The shredder mechanism enabling the at least one article to be shredded to be fed into the cutter elements and the motor is operable to drive the cutter elements so that the cutter elements shred the articles fed therein. The controller is configured to vary running operation of the motor responsive to the detector detecting the thickness of the at least one article being received by the throat.

26 Claims, 9 Drawing Sheets

U.S. PATENT DOCUMENTS 4,890,797 A 1/1990 Fujii et al.
4,914,721 A 4/1990 Glaeser
5,017,972 A 5/1991 Daughton
5,081,406 A 1/1992 Hughes et al.
5,139,205 A 8/1992 Gallagher et al.
5,166,679 A 11/1992 Vranish et al.
5,167,374 A 12/1992 Strohmeyer
5,186,398 A 2/1993 Vigneaux, Jr.
5,198,777 A 3/1993 Masuda et al.
5,342,033 A 8/1994 Iwata
5,345,138 A 9/1994 Mukaidono et al.
5,353,468 A 10/1994 Yap
5,397,890 A 3/1995 Schueler et al.
5,409,171 A 4/1995 Stangenberg et al.
5,415,355 A 5/1995 Gollwitzer
5,429,313 A 7/1995 Schwelling
5,453,644 A 9/1995 Yap
5,494,229 A 2/1996 Rokos
5,539,322 A 7/1996 Zoughi et al.
5,662,280 A 9/1997 Nishio et al.
5,743,521 A 4/1998 Munakata et al.
5,772,129 A 6/1998 Nishio et al.
5,775,605 A 7/1998 Tsai
5,823,529 A 10/1998 Mandel
5,850,342 A 12/1998 Nakamura et al.
5,871,162 A 2/1999 Rajewski
5,924,637 A 7/1999 Niederholtmeyer
D412,716 S 8/1999 Kroger
5,942,975 A 8/1999 Sorenson
D414,198 S 9/1999 Iwata
5,988,542 A 11/1999 Henreckson
6,065,696 A 5/2000 Tsai
D426,805 S 6/2000 Iwata
6,079,645 A 6/2000 Henreckson et al.
6,116,528 A 9/2000 Schwelling
6,141,883 A 11/2000 Mitchell et al.
6,265,682 B1 7/2001 Lee
6,376,939 B1 4/2002 Suzuki et al.
6,418,004 B1 7/2002 Mather et al.
6,550,701 B1 4/2003 Chang
6,561,444 B1 5/2003 Yokomine et al.
6,601,787 B1 8/2003 Langenecker
6,655,943 B1 12/2003 Peterson
6,666,959 B2 12/2003 Uzoh et al.
6,676,460 B1 1/2004 Motsenbocker
6,698,640 B2 3/2004 Hakozaki
6,724,324 B1 4/2004 Lambert
6,802,465 B1 10/2004 Norcott et al.
6,979,813 B2 12/2005 Avril
6,983,903 B2 1/2006 Chang
6,997,408 B2 2/2006 Watano
7,025,293 B2 4/2006 Matlin et al.
7,040,559 B2 5/2006 Matlin
7,166,561 B2 1/2007 Allen
7,213,780 B2 5/2007 Chen
7,311,276 B2 12/2007 Matlin et al.
7,490,786 B2 2/2009 Matlin et al.
7,520,452 B2 4/2009 Watano et al.
7,584,545 B2 9/2009 Pan et al.
7,624,938 B2 12/2009 Aries et al.
7,631,822 B2 12/2009 Matlin et al.
7,631,823 B2 12/2009 Matlin et al.
7,631,824 B2 12/2009 Matlin et al.
7,635,102 B2 12/2009 Matlin et al.
7,661,612 B2 * 2/2010 Lee et al. ..... 241/36
7,661,614 B2 2/2010 Matlin et al.
7,663,769 B2 2/2010 Hayashihara et al.
7,712,689 B2 5/2010 Matlin et al.
2003/0042342 A1 3/2003 Kroger et al.
2004/0008122 A1 1/2004 Michael
2004/0069883 A1 4/2004 Watanabe et al.
2004/0159198 A1 8/2004 Peot et al.
2004/0194594 A1 10/2004 Dils et al.
2004/0226800 A1 11/2004 Pierga
2005/0150986 A1 7/2005 Castronovo
2006/0016919 A1 1/2006 Castronovo
2006/0054725 A1 3/2006 Matlin
2006/0091247 A1 5/2006 Matlin
2006/0219827 A1 10/2006 Matlin
2006/0243631 A1 11/2006 Duke
2007/0007373 A1 1/2007 Matlin
2007/0025239 A1 2/2007 Jain et al.
2007/0063082 A1 3/2007 Coleman
2007/0080252 A1 4/2007 Pierce
2007/0087942 A1 4/2007 Allen
2007/0164135 A1 7/2007 Zhong
2007/0164138 A1 7/2007 Allen
2007/0215728 A1 9/2007 Priester
2007/0221767 A1 9/2007 Matlin
2007/0246582 A1 10/2007 Aries et al.
2008/0093487 A1 4/2008 Lee
2008/0231261 A1 9/2008 Dengler et al.
2009/0025239 A1 1/2009 Pan
2009/0032629 A1 2/2009 Aries et al.
2009/0090797 A1 4/2009 Matlin et al.
2010/0051731 A1 3/2010 Matlin et al.
2010/0084496 A1 4/2010 Matlin et al.
2010/0102153 A1 4/2010 Matlin et al.
2010/0134805 A1 6/2010 Pan
2010/0170967 A1 7/2010 Jensen et al.
2010/0170969 A1 7/2010 Jensen et al.
2010/0176227 A1 7/2010 Davis et al.
2010/0181398 A1 7/2010 Davis et al.
2010/0213296 A1 8/2010 Sued et al.
2010/0213297 A1 8/2010 Sued et al.
2010/0213300 A1 8/2010 Matlin et al.
2010/0243774 A1 9/2010 Hu et al.
2010/0252661 A1 10/2010 Matlin et al.
2010/0252664 A1 10/2010 Matlin et al.
2010/0270404 A1 10/2010 Chen
2010/0282879 A1 11/2010 Chen
2010/0288861 A1 11/2010 Cai et al.
2010/0320297 A1 12/2010 Matlin et al.
2010/0320299 A1 12/2010 Matlin et al.

FOREIGN PATENT DOCUMENTS

DE 8619856.4 10/1988
DE 4121330 1/1993
DE 4207292 1/1993
DE 4237861 5/1994
DE 4437348 4/1996
DE 19835093 2/1999
DE 202004000907 5/2005
DE 102006036136 1/2008
DE 202010001577 U1 11/2010
EP 268244 11/1987
EP 0392867 10/1990
EP 562076 9/1992
EP 524708 1/1997
EP 0792691 9/1997
EP 0818241 1/1998
EP 856945 1/1998
EP 855221 7/1998
EP 1177832 2/2002
EP 1195202 4/2002
EP 2180290 7/2008
EP 2022566 2/2009
GB 1199903 7/1970
GB 2171029 8/1986
GB 2209963 6/1989
GB 2440651 2/2008
GB 2442942 4/2008
GB 2451513 2/2009
JP 52-11691 1/1977
JP 57-070445 4/1982
JP 57-070445 U 4/1982
JP 57-76734 5/1982
JP 58-223448 12/1983
JP 61-000702 1/1986
JP 63-173342 11/1988
JP 2-277560 11/1990
JP H2-303550 12/1990
JP 04-157093 5/1992
JP 04-0180852 6/1992
JP 5-96198 4/1993
JP H05-092144 4/1993
JP 6-277548 10/1994

| | | |
|---|---|---|
| JP | 7-299377 | 11/1995 |
| JP | 8-108088 | 4/1996 |
| JP | 8-131861 | 5/1996 |
| JP | 08-131962 | 5/1996 |
| JP | 08-164343 | 6/1996 |
| JP | 9-38513 | 2/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 2000346288 | 12/2000 |
| JP | 2002-239405 | 8/2002 |
| JP | 2004-321840 | 11/2004 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

U.S. Appl. No. 60/613,750, filed Sep. 27, 2004, Pierce.
U.S. Appl. No. 60/686,490, filed May 31, 2005, Pierce.
U.S. Appl. No. 60/688,285, filed Jun. 7, 2005, Pierce.
Invitation to Pay Additional Fees with Partial International Search Report in PCT/US2009/069426, mailed Jun. 1, 2010.
International Preliminary Report on Patentability for PCT/US2009/069426 dated Mar. 15, 2011.
Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.
ACCO REXEL, Mainstream 1050/2150/2250/3150/3250 and 3350, 115V Machines Illustrated Parts Lists and Services Instructions, Mar. 25, 2002, Issue No. 4.
ACCO REXEL, Deckside and Office 115V Machines Illustrated Parts Lists and Service Instructions, Aug. 18, 1999.
ACCO REXEL, Deckside and Office 230V Machines Illustrated Parts Lists and Service Instructions, Aug. 1, 2000.
English Translation of Japanese Patent Application Publication No. 9-38513, published on Feb. 10, 1997.
GBC Shredmaster Service Manual, Part #6001054, referencing Models 2230S and 2250X Paper Shredders, Nov. 1997.
The Stationary and Business Machines—Japan, "DS-4000 by Carl Jimuki K.K.", Jun. 2003.
The Stationary and Business Machines—Japan, "NSE-501CN by Nakabayashi K.K.", Oct. 2004.

* cited by examiner

THICKNESS SENSOR BASED MOTOR CONTROLLER

BACKGROUND OF THE INVENTION

1. Field of the Invention

The present invention relates to shredders for destroying articles, such as documents, compact discs, etc.

2. Description of Related Art

Shredders are well known devices for destroying articles, such as paper, documents, compact discs ("CDs"), expired credit cards, etc. Typically, users purchase shredders to destroy sensitive information bearing articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. The shredder typically has a stated capacity, such as the number of sheets of paper (typically of 20 lb. weight) that may be shredded at one time; however, the feed throat of a typical shredder can receive more sheets of paper than the stated capacity. This is typically done to make feeding easier. A common frustration of users of shredders is to feed too many papers into the feed throat, only to have the shredder jam after it has started to shred the papers. To free the shredder of the papers, the user typically reverses the direction of rotation of the cutter elements via a switch until the papers become free.

The assignee of the present application, Fellowes, Inc., has developed thickness sensing technologies for shredders. By sensing thickness of the articles being fed, the shredder can be stopped (or not started) before a jam occurs. See U.S. Patent Application Publication Nos. 2006-0219827 A1, 2006-0054725 A1, 2007-0007373 A1 and 2007-0221767 A1, and U.S. patent application Publication Ser. No. 11/867,260, each of which is incorporated by reference herein in their entirety.

Sheet capacity, shredding speed, and energy efficiency are three important parameters of a shredder. Prior art shredders have attempted to address the issue of energy efficiency or energy savings by using a closed-loop feedback based motor control circuits. For example, see U.S. Patent Publication Nos. 2007-0164135 A1 and U.S. Pat. No. 6,997,408, each of which is incorporated by reference herein in their entirety.

BRIEF SUMMARY OF THE INVENTION

In an embodiment, a shredder is provided. The shredder includes a housing having a throat for receiving at least one article to be shredded, a shredder mechanism received in the housing, a detector, and a controller coupled to a motor and the detector. The shredder mechanism includes the electrically powered motor and cutter elements. The shredder mechanism enabling the at least one article to be shredded to be fed into the cutter elements. The motor is operable to drive the cutter elements so that the cutter elements shred the articles fed therein. The detector is configured to detect a thickness of the at least one article being received by the throat. The controller is configured to vary the running operation of the motor responsive to the detector detecting the thickness of the at least one article being received by the throat.

In another embodiment, a method for operating a shredder is provided. The method uses a shredder that includes a housing having a throat for receiving at least one article to be shredded, a thickness detector for detecting a thickness of the at least one article to be shredded inserted in the throat, and a shredder mechanism received in the housing. The shredder mechanism includes an electrically powered motor and cutter elements, the shredder mechanism. The shredder mechanism enabling the at least one article to be shredded to be fed into the cutter elements. The motor being operable drive the cutter elements in a shredding direction so that the cutter elements shred the articles fed therein. The method includes detecting with the thickness detector a thickness of the at least one article to be shredded inserted into the throat; and varying running operation of the motor responsive to the detector detecting the thickness of the at least one article being received by the throat.

Other aspects, features, and advantages of the present invention will become apparent from the following detailed description, the accompanying drawings, and the appended claims.

DETAILED DESCRIPTION OF THE INVENTION

The present invention relates to a shredder for destroying articles, such as documents, and CDs, specifically one capable of controlling motor torque, motor speed and energy efficiency based on the thickness of articles received by a throat of the shredder.

According to an aspect of the present invention, an intelligent motor controller for the shredder is provided. The motor controller is capable of predetermining the thickness of the articles received by the throat of the shredder, and accordingly adjusting the speed and the torque characteristic of the motor, which powers the shredder mechanism, based on an input (i.e., the thickness of the articles) from a thickness detector. The controller is able to enhance either shredding speed, shredding capacity or energy efficiency of the shredder.

According to an aspect of the present invention, an open-loop control system is provided that is capable of predetermining the speed and torque of the motor based on the thickness of the article to be shredded. The present invention may be implemented in conjunction with an induction motor, a universal motor or a brushless DC motor or any other electric motor with capability for torque or speed control.

The present invention anticipates the required speed and torque of the motor based on the thickness of at least one article before the article even enters the cutter elements. The present invention is therefore able to determine the motor torque, the motor speed or energy efficiency before it turns on the motor. It is also able to variably adjust the shredding speed, capacity and energy efficiency during the shredding operation before the motor is affected by the change in load, thereby improving energy efficiency.

Figure 1:
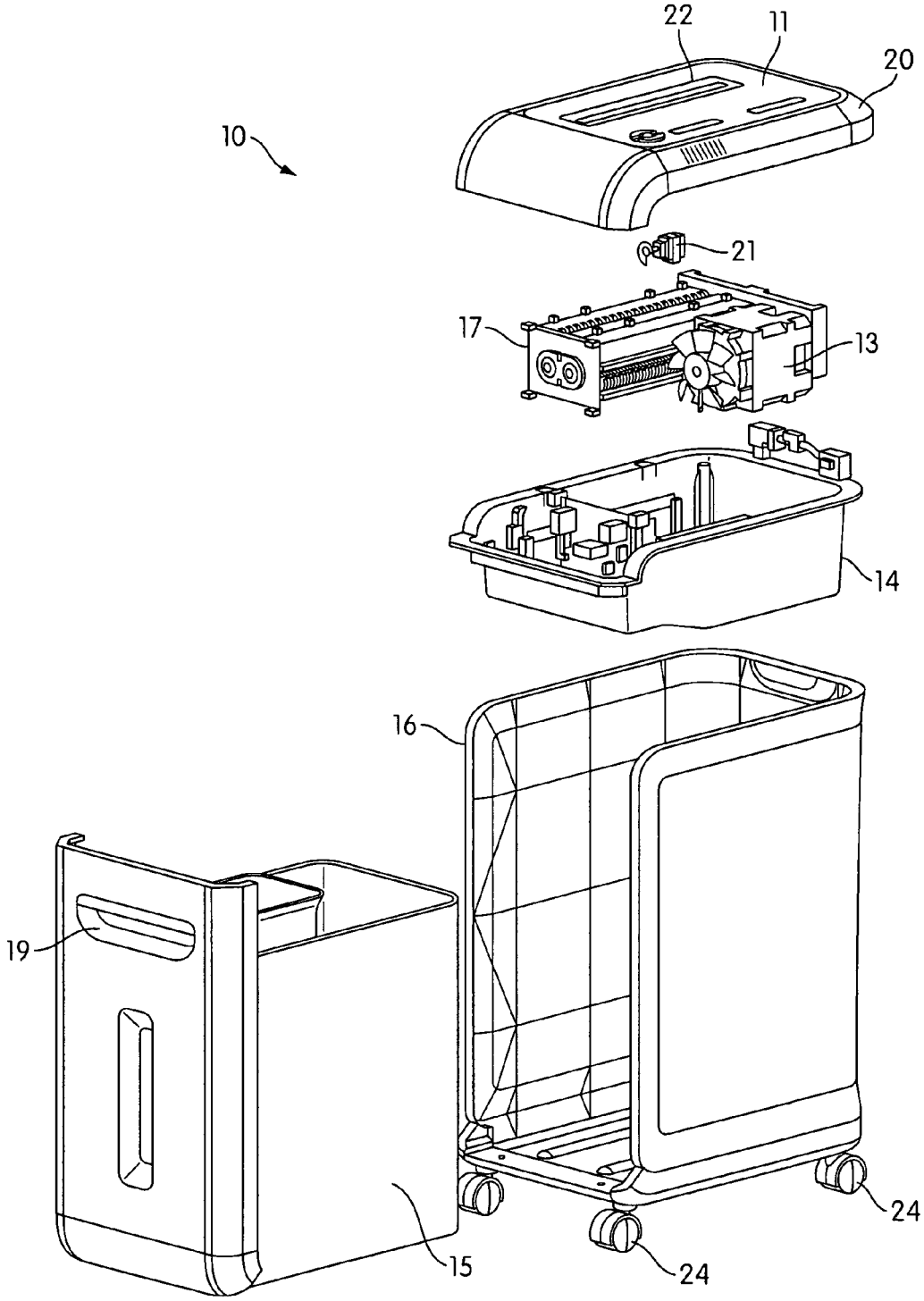
FIG. 1 is an exploded perspective view of a shredder constructed in accordance with an embodiment of the present invention.
Figure 3:
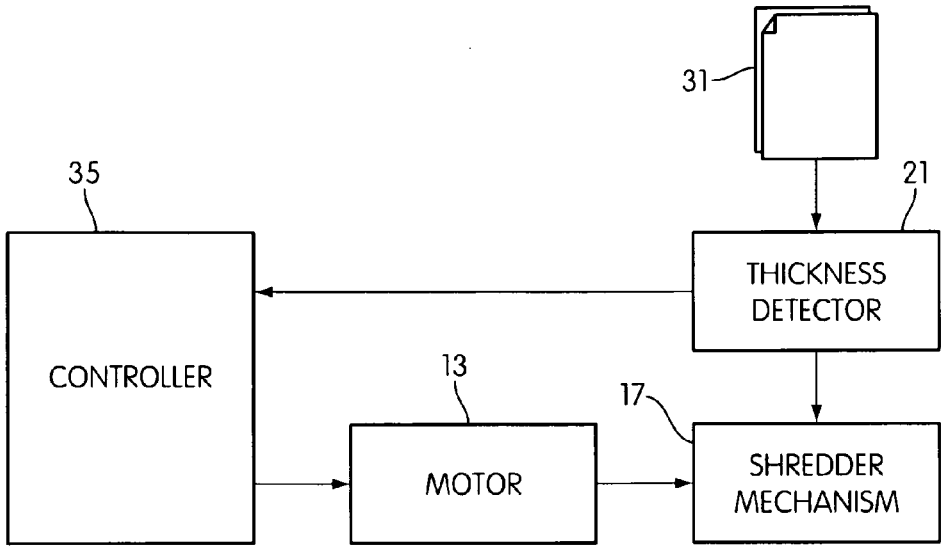
FIG. 3 is schematic illustration of interaction between a controller and other parts of the shredder.

FIG. 1 illustrates a shredder constructed in accordance with an embodiment of the present invention. The shredder is generally indicated at 10. The shredder includes a housing 20 having a throat 22 for receiving at least one article 31 (as shown in FIG. 3) to be shredded, a shredder mechanism 17 received in the housing 20, a detector 21, and a controller 35 (as shown in FIG. 3) coupled to a electrically powered motor 13 and the detector 21. The shredder mechanism 17 includes the motor 13 and cutter elements. The shredder mechanism 17 enabling the at least one article 31 to be shredded to be fed into the cutter elements. The motor 13 is operable to drive the cutter elements so that the cutter elements shred the articles 31 fed therein. The detector 21 is configured to detect a thickness of the at least one article 31 received by the throat 22. The controller 35 is configured to vary the running operation of the motor responsive to the detector detecting the thickness of the at least one article being received by the throat.

The shredder 10 includes the shredder housing 20, mentioned above. The shredder housing 20 includes a top cover 11, and a bottom receptacle 14. The shredder housing 20 includes the top cover or wall 11 that sits atop the upper periphery of the bottom receptacle 14. The top cover or wall 11 is molded from a plastic material or any other material. The shredder housing 20 and its top wall or cover 11 may have any suitable construction or configuration. The top cover or wall 11 has an opening, which is often referred to as the throat 22, extending generally parallel and above the cutter elements. The throat 22 enables the articles being shredded to be fed into the cutter elements. As can be appreciated, the throat 22 is relatively narrow, which is desirable for preventing overly thick items, such as large stacks of documents, from being fed into cutter elements, which could lead to jamming. The throat 22 may have any configuration.

The shredder 10 includes the bottom receptacle 14 having a bottom wall, four side walls and an open top. The bottom receptacle 14 is molded from a plastic material or any other material. The bottom receptacle 14 sits atop the upper periphery of the bottom housing 16 in a nested relation using flange portions of the bottom receptacle 14 that generally extend outwardly from the side walls thereof. The shredder mechanism 17 along with the motor 13, and the detector 21 are configured to be received in the bottom receptacle 14 of the shredder housing 20. The bottom receptacle 14 may be affixed to the underside of the top cover or wall 11 by fasteners. The receptacle 14 has an opening in its bottom wall through which the shredder mechanism 17 discharges shredded articles into the container 15.

As noted above, the shredder 10 includes the shredder mechanism 17 that includes the electrically powered motor 13 and a plurality of cutter elements. "Shredder mechanism" is a generic structural term to denote a device that destroys articles using at least one cutter element. Such destroying may be done in any particular way. For example, the shredder mechanism may include at least one cutter element that is configured to punch a plurality of holes in the document or article in a manner that destroys the document or article. In the illustrated embodiment, the cutter elements are generally mounted on a pair of parallel rotating shafts. The motor 13 operates using electrical power to rotatably drive the shafts and the cutter elements through a conventional transmission so that the cutter elements shred articles fed therein. The shredder mechanism 17 may also include a sub-frame for mounting the shafts, the motor 13, and the transmission. The operation and construction of such a shredder mechanism 17 are well known and need not be described herein in detail. Generally, any suitable shredder mechanism 17 known in the art or developed hereafter may be used.

In the illustrated embodiment, the shredder 10 sits atop the large freestanding housing 16, which is formed of molded plastic material or any other material. The housing 16 includes a bottom wall, three side walls, an open front and an open top. The side walls of the container 16 provide a seat on which the shredder housing 20 is removably mounted. The housing 16 is constructed and arranged to receive the waste container 15 therein. In other words, the waste container 15 is enclosed in the housing 16. The waste container 15 is formed of molded plastic material or any other material. The waste container 15 is in the form of a pull-out bin that is constructed and arranged to slide in and out of the housing 16 through an opening in the front side thereof. The waste container 15 is configured to be removably received within the housing 16. The waste container 15 includes a bottom wall, four side walls, and an open top. The waste container 15 includes a handle 19 that is configured to allow a user to grasp and pull out the waste container 15 from the housing 16. In the illustrated embodiment, the handle 19 is located on the front, side wall of the waste container 15. Any construction or configuration for the housing or waste container may be used, and the illustrated embodiment is not limiting.

As an option, the housing 16 along with the shredder 10 can be transported from one place to another by simply rolling the housing 16 on roller members 24, such as wheels or casters. In the illustrated embodiment, the housing 16 includes two pairs of roller members 24 attached to the bottom of the frame of the housing 16 to rollingly support the housing 16. The rolling members 24 can be located on the housing 16 as near the corners as practical. The roller members 24, in one embodiment, may be locked against rolling motion by lock members to provide a stationary configuration. In one embodiment, the front pair of the roller members 24 may be in the form of casters that provide a turning capability to the housing 16, while the rear pair of the roller members 24 may be in the form of wheels that are fixed in direction, so as to only allow roll in the intended direction of travel. In another embodiment, the front and rear pair of the roller members 24 may in the form of casters.

The cover 11 may include a switch recess with an opening therethrough. An on/off switch that includes a switch module may be mounted to the top cover 11 underneath the switch recess by fasteners, and a manually engageable portion that moves laterally within the switch recess. The switch module has a movable element that connects to the manually engageable portion through the opening. This enables movement of the manually engageable portion to move the switch module between its states.

The switch module is configured to connect the motor 13 to the power supply. This connection may be direct or indirect, such as via a controller. Typically, the power supply will be a standard power cord with a plug on its end that plugs into a standard AC outlet. The switch is movable between an on position and an off position by moving the manually engageable portion laterally within the switch recess. In the on position, contacts in the switch module are closed by movement of the manually engageable portion and the movable element to enable a delivery of electrical power to the motor 13. In the off position, contacts in the switch module are opened to disable the delivery of electric power to the motor 13. Alternatively, the switch may be coupled to a controller, which in turn controls a relay switch, TRAIC etc. for controlling the flow of electricity to the motor 13, as will be described in detail below.

As an option, the switch may also have a reverse position wherein contacts are closed to enable delivery of electrical power to operate the motor 13 in a reverse manner. This would be done by using a reversible motor and applying a current that is of a reverse polarity relative to the on position. The capability to operate the motor 13 in a reversing manner is desirable to move the cutter elements in a reversing direction for clearing jams. In the off position the manually engageable portion and the movable element would be located generally in the center of the switch recess, and the on and reverse positions would be on opposing lateral sides of the off position.

Generally, the construction and operation of the switch for controlling the motor 13 are well known and any construction for such a switch may be used. For example, the switch need not be mechanical and could be of the electro-sensitive type described in U.S. patent application Ser. No. 11/536,145, which is incorporated herein by reference. Likewise, such as switch may be entirely omitted, and the shredder can be started based on insertion of an article to be shredded.

Generally speaking, the shredder 10 may have any suitable construction or configuration and the illustrated embodiment is not intended to be limiting in any way. In addition, the term "shredder" is not intended to be limited to devices that literally "shred" documents and articles, but is instead intended to cover any device that destroys documents and articles in a manner that leaves each document or article illegible and/or useless.

Figure 2:
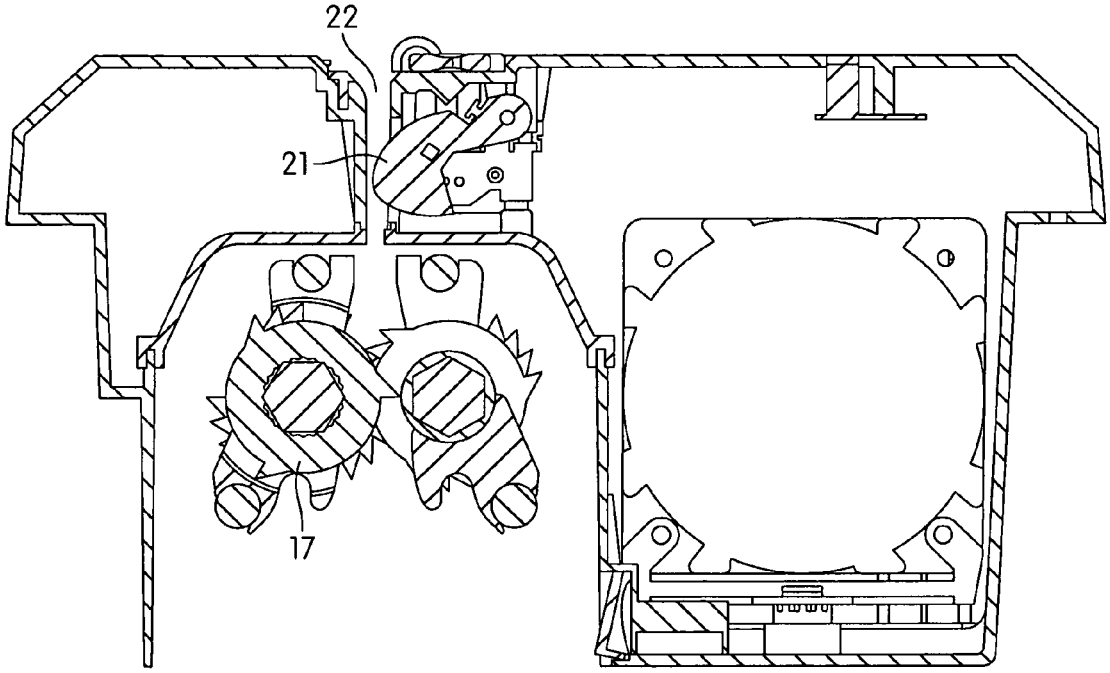
FIG. 2 is a cross-sectional view of the shredder of FIG. 1, wherein a detector configured to detect a thickness of an article to be shredded by the shredder in accordance with an embodiment of the present invention.

FIG. 2 shows the detector 21 that may be used to detect the thickness of articles (e.g., a compact disc, credit card, stack of paper, etc.) that are placed in the throat 22 of the shredder 10. The detector 21 includes a contact member that extends into the throat 22 and is actuated in response to the article being inserted into the throat 22. The detector 21 may include a strain gauge configured to measure movement of the contact member and communicate the movement to a controller. The detector 21 may include a piezoelectric sensor configured to measure movement of the contact member and communicate the movement to a controller. The detector 21 may include an optical sensor configured to measure movement of the contact member and communicate the movement to a controller. The optical sensor may include an infrared LED and a dual die infrared receiver configured to detect the direction and amount of the movement. Reference may be made to U.S. Patent Application Publication No. 2006-0219827 A1, which is hereby incorporated by reference, for details of a detector that is configured to detect a thickness of the at least one article received by the throat. The detector may have any construction or configuration, and the illustrated embodiment is not limiting.

FIG. 3 shows the controller 35 capable of controlling the motor 13 that powers the shredder mechanism 17. The detector 21 is configured to detect the thickness of the articles 31 received by the throat 22 of the shredder 10, and to relay the thickness of the articles 31 to the controller 35. The controller or control circuit 35 is then able to adjust or vary the running operation of the motor based on detected thickness of the articles 31 received from the detector 21.

Figure 5:
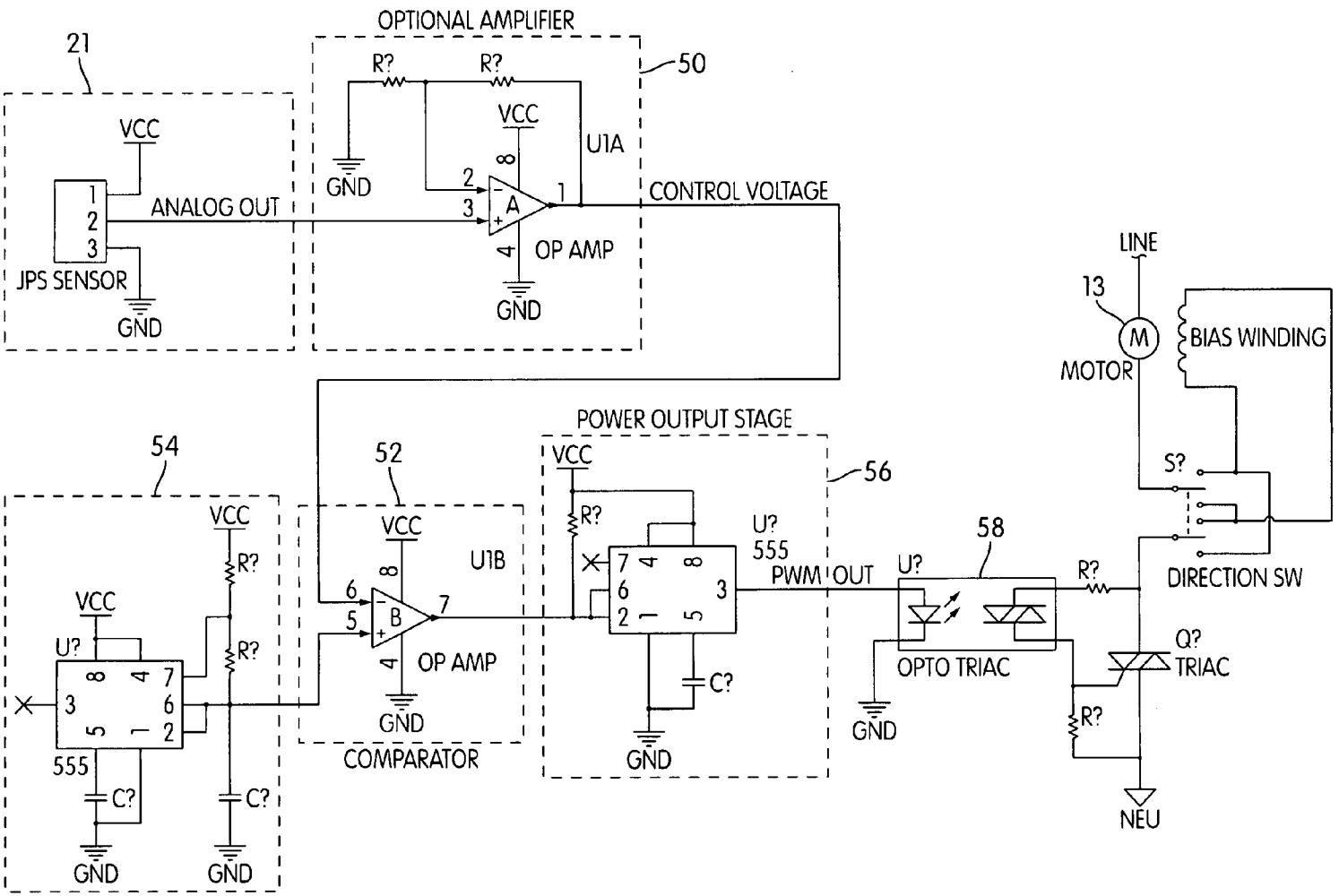
FIG. 5 is a schematic circuit illustration of an embodiment of the present invention, wherein the detector is interfaced to a timer circuit.

The controller 35 may be configured to adjust torque of the motor 13 responsive to the detector 21 detecting the thickness of the at least one article 31 received by the throat 22. The controller 35 may be configured to adjust speed of the motor 13 responsive to the detector 21 detecting the thickness of the at least one article 31 received by the throat 22. The controller 35 may be configured to adjust power usage of the motor 13 responsive to the detector 21 detecting the thickness of the at least one article 31 received by the throat 22. The controller 35 may be configured to prevent the motor 13 from driving the cutter elements and to provide an alarm indication to alert a user responsive to the detector 21 detecting that the thickness of the at least one article 31 is greater than a predetermined maximum thickness threshold. The alarm indication may include illuminating a visual indicator and/or sounding an audible alarm indicator. The controller 35 may include a microcontroller (as shown in FIGS, 6 and 7) or a timer circuit (as shown in FIG. 5). According to an aspect of the present invention, the controller 35 is configured to vary running operation of the motor continuously responsive to the detector detecting the thickness of the at least one article received by the throat. According to another aspect of the present invention, the controller 35 is configured to vary running operation of the motor based on predefined discrete ranges of thicknesses responsive to the detector detecting the thickness of the at least one article received by the throat.

Figure 4:
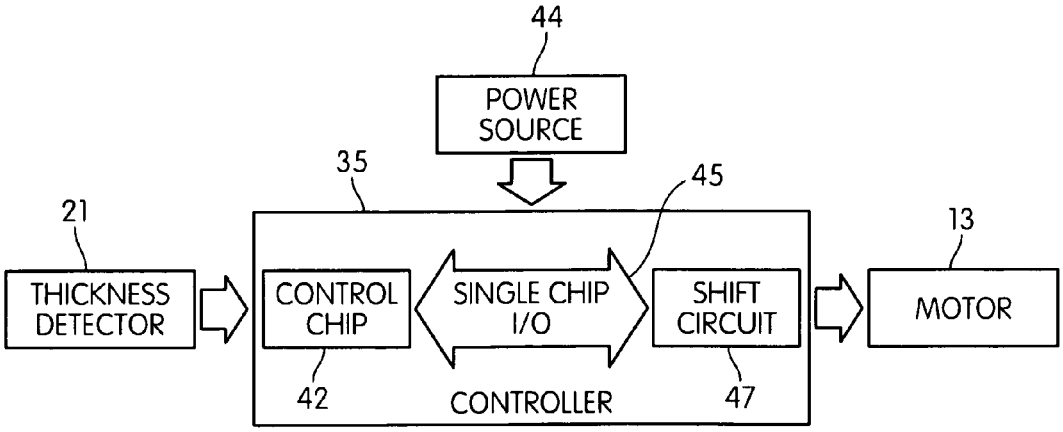
FIG. 4 is a schematic illustration of a more detailed implementation of the controller of FIG. 3 in accordance with an embodiment of the present invention.

FIG. 4 is a schematic illustration of a more detailed implementation of the controller 35 in accordance with an embodiment of the present invention. The controller or control circuit 35 includes a control chip 42, and a shift circuit 47 electrically connected via a single chip input/output 45. The controller or control circuit 35 is powered via a power source 44, and is capable of controlling the motor 13 with the use of the shift circuit 47. The control chip 42 is configured to receive the input signals from the detector 21. More specifically, control chip 42 is configured to receive the thickness of the articles 31 from the detector 21. The control chip 42 then sends that the thickness of the articles 31 via the single chip input/output 45 to the shift circuit 47. The shift circuit 47 is configured to specify the operational setting for the motor 13. In other words, the shift circuit 47 is configured generate a set of output signals that regulate the application of voltages to the motor 13. The shift circuit 47 determines the appropriate motor speed, motor torque or power setting to be used.

FIG. 5 illustrates a schematic circuit of an embodiment of the present invention, wherein the detector 21 is interfaced to a timer circuit. The embodiment, as shown in FIG. 5, illustrates a schematic circuit that does not require a microcontroller. As shown in FIG. 5, the circuit uses the thickness of the articles 31 detected by the detector 21. The output from the detector 21 may be an analog output. That is, as the thickness of the articles 31 detected by the detector 21 increases or decreases, a voltage or current is produced by the detector output may either increase or decrease accordingly. In one embodiment, the voltage or current produced by the detector output does not have to be directly proportional to the thickness of the articles 31 detected by the detector 21. The output from the detector 21 is then passed through an amplifier stage.

In the amplifier stage, an amplifier circuit 50 is configured to condition the output from the detector 21. This may be done to increase, offset, or filter the output from the detector 21. The amplifier stage is an optional stage, but may be used to bring the output range of the detector 21 to a desired level. The output of the amplifier stage (i.e., the conditioned signal) is then sent to a comparator stage.

In the comparator stage, a comparator circuit 52 is configured to compare the control voltage of the detector 21 to an output of an astable oscillator circuit 54. The positive input of the comparator stage is connected to the astable oscillator circuit 54 from a timer, such as a 555 timer. The frequency and pulse width are determined by the two resistors and the capacitor connected to pins 6 and 7 of the oscillator circuit 54. Based on the comparison, the comparator circuit 52 outputs a pulse width modulated signal. The pulse width modulated signal produced by the comparator circuit 52 is directly proportional to the control voltage.

Figure 8:
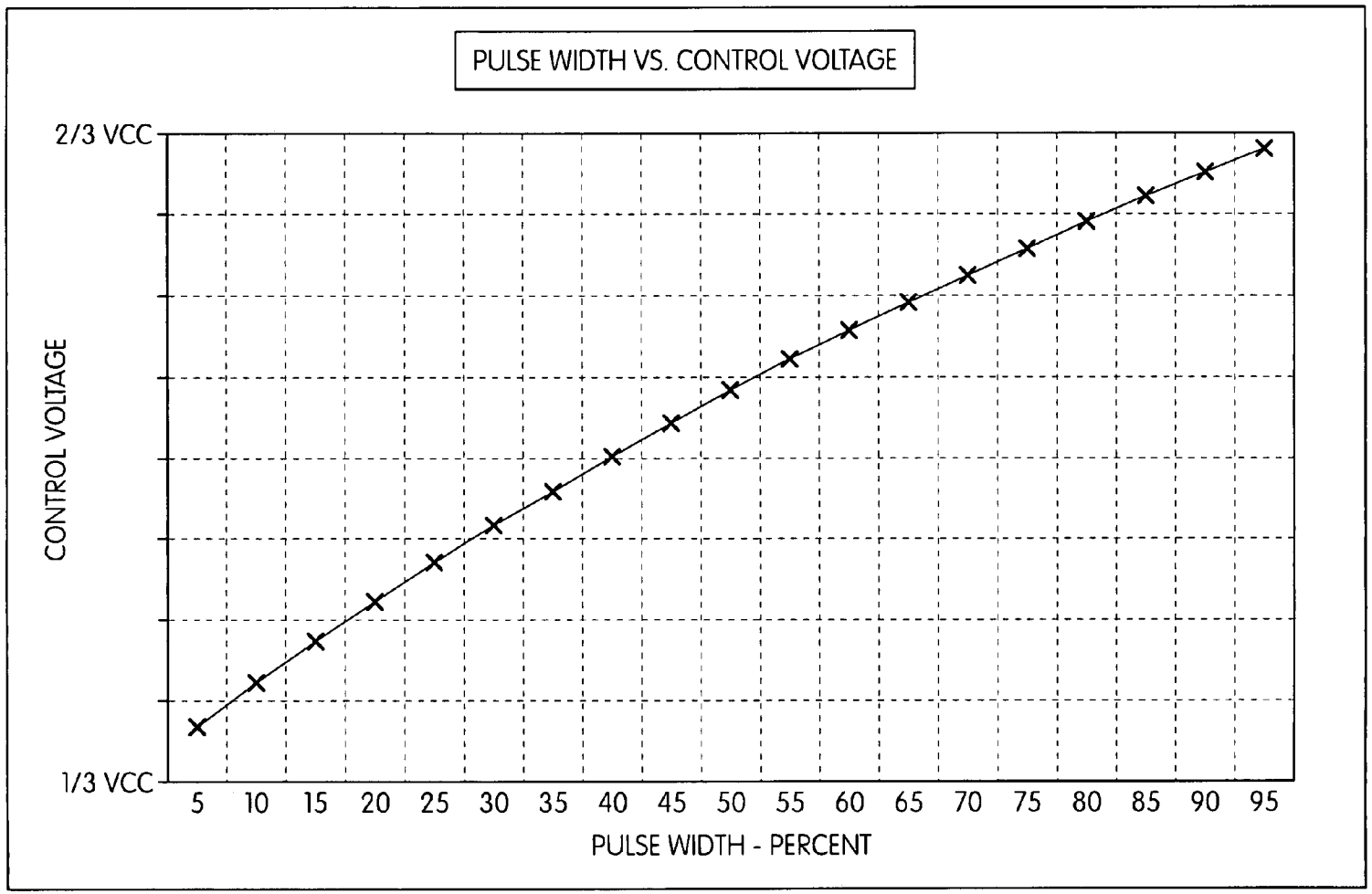
FIG. 8 is a graph illustrating the control voltage versus the pulse width modulated output signal.

FIG. 8 shows a graph illustrating pulse width modulation signal vs. control voltage. Graph illustrates the pulse width modulation signal as a percentage value represented on a horizontal x-axis. On a vertical y-axis, the graph illustrates control voltage.

The output duty cycle of the comparator circuit 52 increases as the output of the detector 21 increases. This relationship can be inverted if the pins of the comparator circuit 52 are switched. That is, the positive and negative signals for the comparator circuit 52 may be reversed to produce a decreasing pulse width for an increase in control voltage. The output of the comparator circuit 52 is then routed to a power output stage 56.

In the power output stage 56, a second timer, such as a 555 timer, is used to control the drive of an opto-TRIAC 58. The TRIAC 58 is turned on when the output of the second timer circuit is high. In other words, the pulse width modulation output from the power output stage 56 is fed into the TRIAC 58 which is used to drive the motor 13. The power output stage 56 is optional, but is used as an output buffer. Generally, an output buffer is used to drive an output of a device based on an output from another device. In other words, the output buffer is typically used when a device is not capable of driving the output directly. The power output stage 56, shown in FIG. 5, is used as an output buffer to drive the TRIAC 58, when the comparator stage 52 is unable to directly drive the TRIAC 58.

As the pulse width modulation duty cycle increases, the TRIAC 58 will be turned on more and more. This will allow the motor 13 to run at full drive when the thickness of the articles 31 inserted into the throat is high. The resulting function is a change in motor speed and energy consumption relative to the output of the detector 21. As the thickness of the articles 31 inserted into the throat is high (e.g., higher the output from the detector 21), the speed and power of the motor 13 is increased accordingly. This allows the motor. 13 to run as quietly and efficiently as possible.

In one embodiment, the circuit shown in FIG. 5 is configured to operate using a universal motor. When using the universal motor, the motor is configured to run at a low speed and a lower torque for thin documents. This is mainly because lower duty cycle is not configured to deliver torque gains with the universal motors. As the thickness of the documents increases, duty cycle increases. As the duty cycle increases, the motor speed is increased that would in turn provide a nominal torque (i.e., a modulated torque).

In another embodiment, the circuit shown in FIG. 5 is modified to operate using a brushless DC motor (i.e., BLDC motor). In such configuration, the motor is configured to operate at a high speed and low torque for thin documents, and operate at a lower speed and higher torque for thicker documents.

Figure 9:
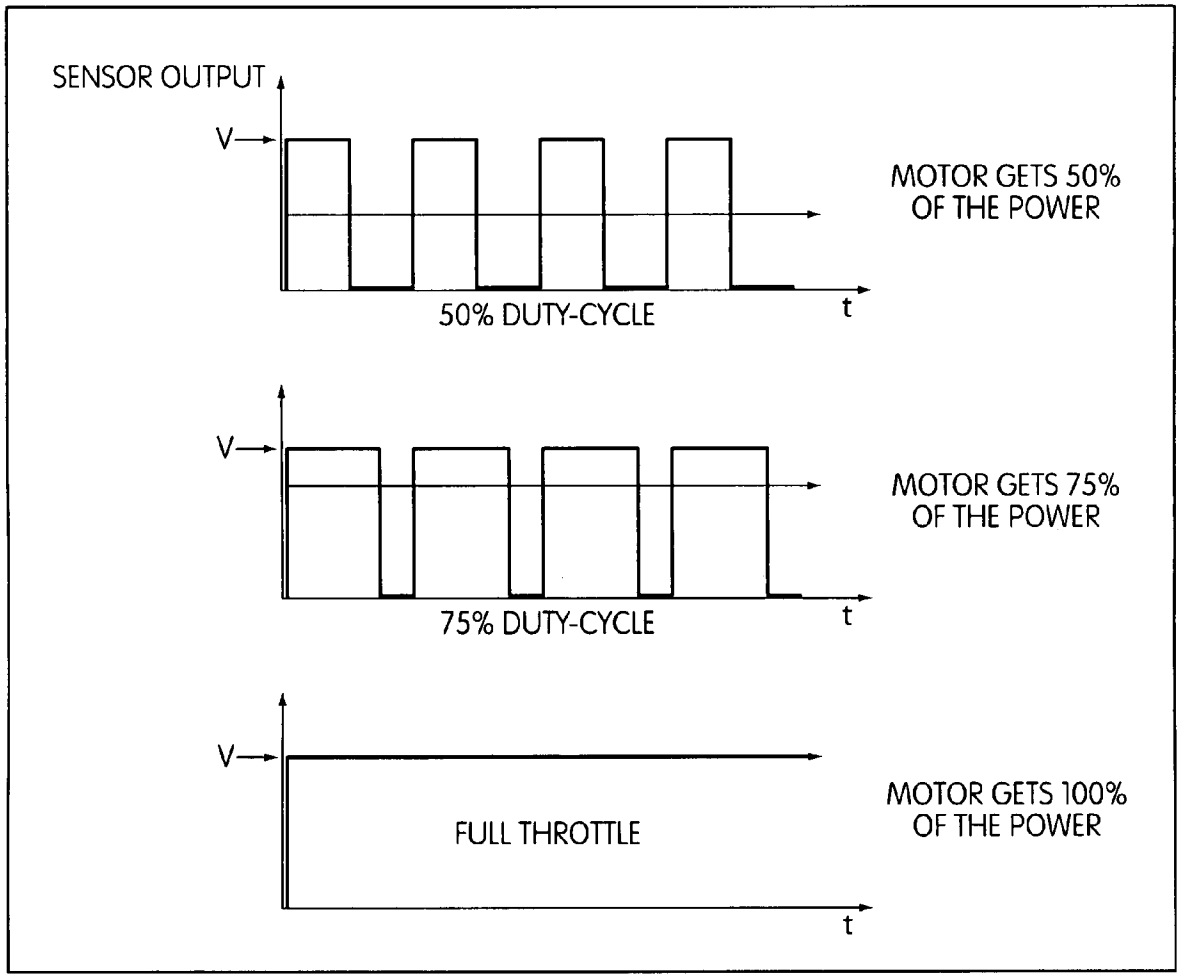
FIG. 9 shows various duty cycles of the pulse width modulated output signals.

FIG. 9 shows graphs of various duty cycles of pulse width modulation output signals. For example, as shown in FIG. 9, when the pulse width modulation signal is at 50% duty cycle, the motor 13 is configured to receive 50% of the power, when the pulse width modulation signal is at 75% duty cycle, the motor 13 is configured to receive 75% of the power, and when the pulse width modulation signal is at its maximum, the motor 13 is configured to receive 100% of the power.

Figure 6:
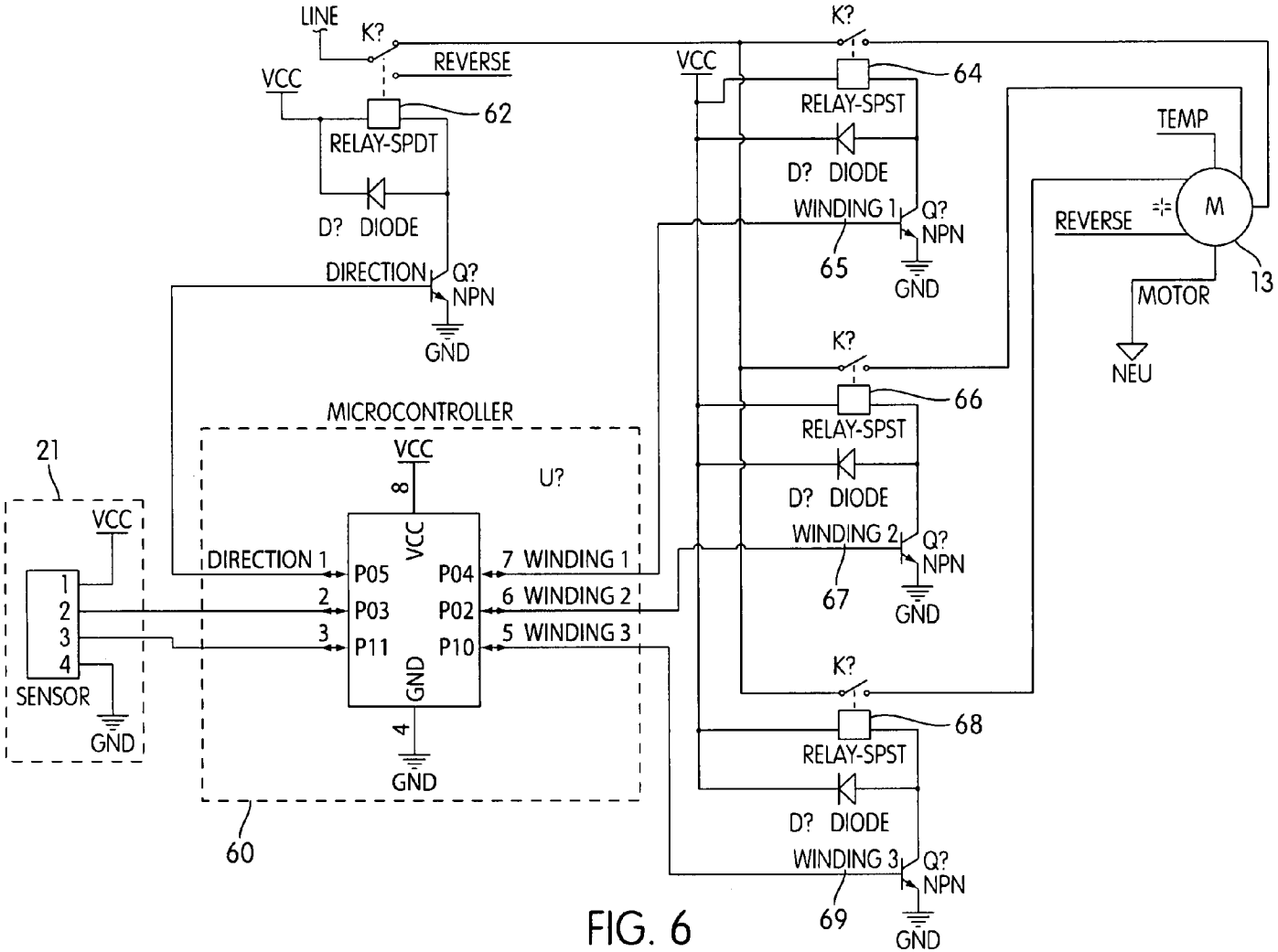
FIG. 6 is a schematic circuit illustration of an embodiment of the present invention, wherein the detector is interfaced to a microcontroller using multiple relays.

FIG. 6 illustrates is a schematic circuit illustration of an embodiment of the present invention, wherein the detector 21 is interfaced to a microcontroller 60 using multiple relays.

The output of the detector 21 is sent to the microcontroller 60. The detector 21 may produce an analog output, or a digital signal. The microcontroller 60 is configured to evaluate the output of the detector 21 and to power the different relays 64, 66 and 68 to the motor 13 accordingly. The different relays 64, 66 and 68 may be switched to control either: speed, energy consumption, and torque of the motor 13. The switching of different relays 64, 66 and 68 may determined by a software, for example a look-up table, curve, or function stored in the memory of the controller 35, that may be adjusted as required.

A relay 62 is configured to control the direction of rotation, while the other three relays 64-68 are used to switch power to different motor windings 65, 67 and 69 respectively. These windings 65, 67 and 69 can be used to provide, for example, extra torque, have different speed characteristics, etc. The utilization of the windings 65, 67 and 69 may be determined in a software, such as a look-up table, curve, or function stored in the memory of the controller 35, based on the thickness of the articles 31 detected by the detector 21.

Figure 7:
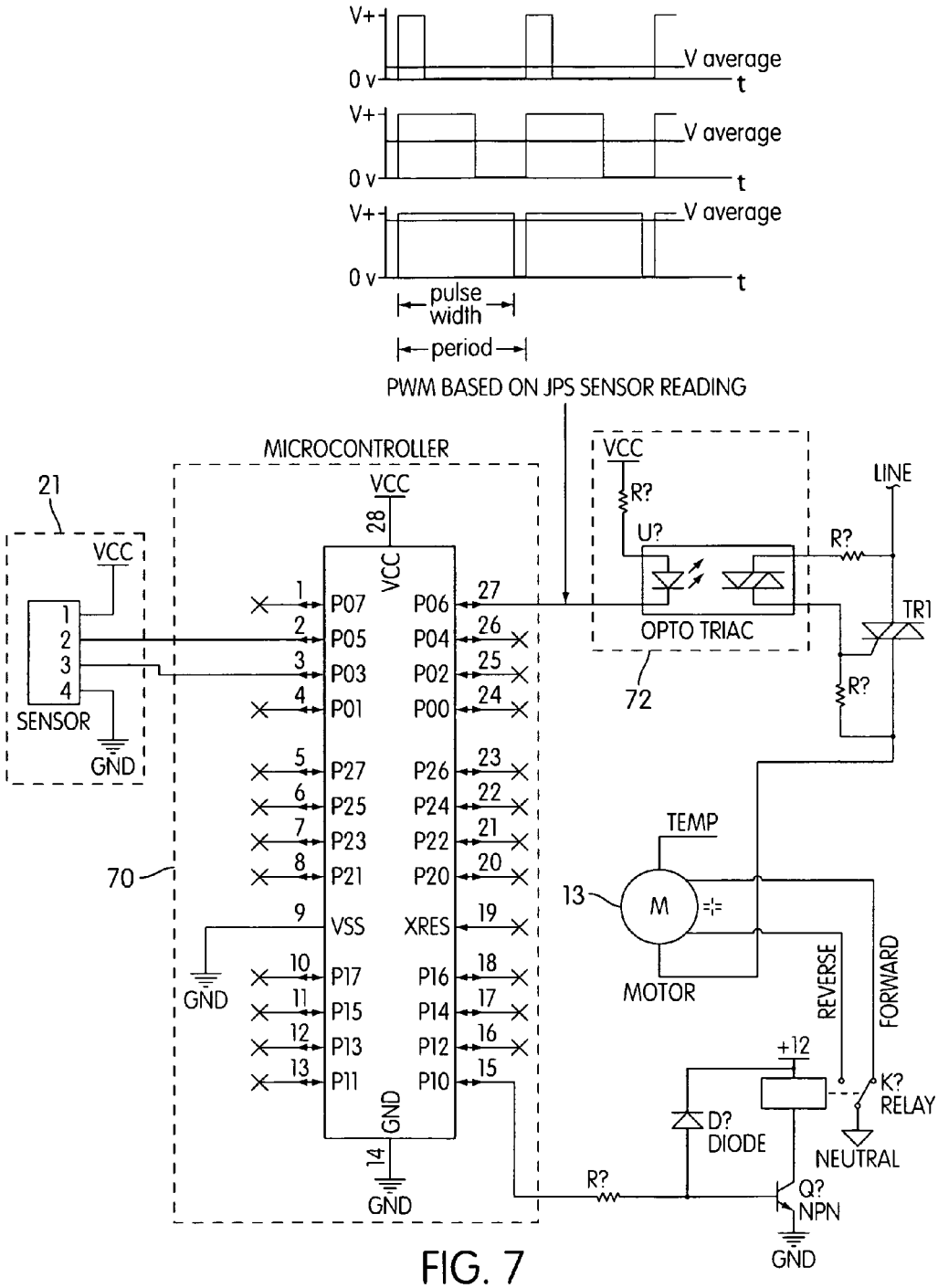
FIG. 7 is a schematic circuit illustration of an embodiment of the present invention, wherein the detector is interfaced to a microcontroller using pulse width modulation.

FIG. 7 illustrates is a schematic circuit illustration of an embodiment of the present invention, wherein the detector 21 is interfaced to a microcontroller 70 using pulse width modulation.

The output of the detector 21 is sent to the microcontroller 70. The detector 21 may produce an analog output, or a digital signal. Based on the output from the detector 21, the microcontroller 70 is configured to change the duty cycle of the motor drive by pulse width modulating an opto-TRIAC 72. This embodiment invokes a response similar to that described in the timer circuit with respect to FIG. 5.

The microcontroller 70 of this embodiment is used in the place of the amplifier circuit 50, the oscillator circuit 54, the comparator circuit 52, and power output stage 56 of the timer circuit described with respect to FIG. 5. FIG. 7 also shows various duty cycles of the pulse width modulation signal based on the thickness of the articles 31. This information is stored as calibration data in the memory of the controller 35, for example in the form of a look-up table, curve, or function. Based off the calibration data, the microcontroller 70 produces a pulse width modulation output relative to the appropriate thickness detected by the detector 21. The pulse width modulation output is sent to the TRIAC 72 and is used to drive the motor 13 at the appropriate duty cycle.

Figure 10:
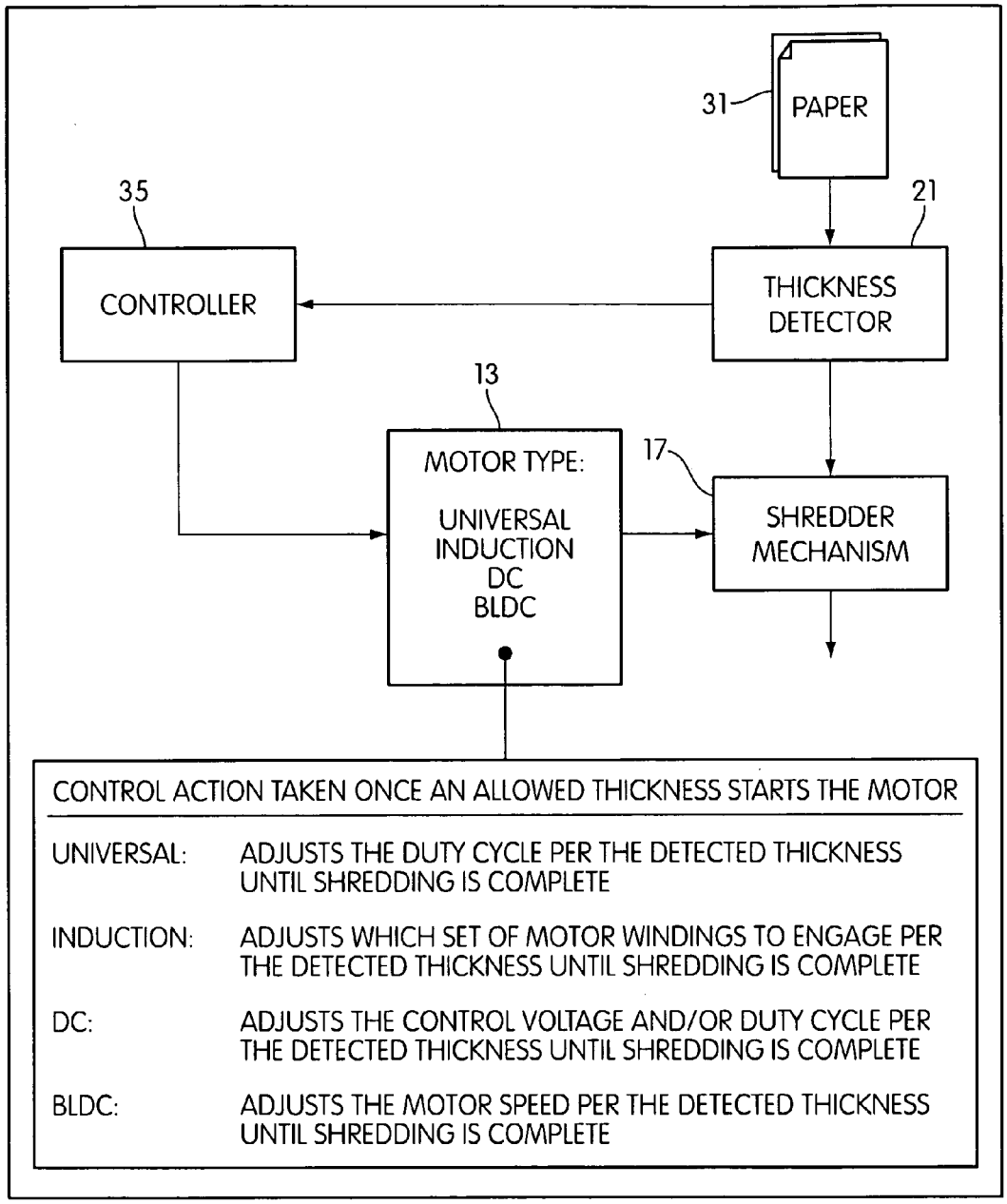
FIG. 10 shows a schematic illustration of interaction between the controller and other parts of the shredder, wherein different types of motors that may be used are shown.

As noted above, the present invention may be implemented in conjunction with an induction motor, a universal motor or a brushless DC motor or any other electric motor with capability for torque or speed control. FIG. 10 shows a schematic illustration of interaction between the controller and other parts of the shredder, wherein different types of motors that may be used are illustrated.

When a universal motor is used, the duty cycle of the drive signal may be adjusted relative to the thickness of the at least one article being received by the throat. In other words, the universal motor adjusts the duty cycle of the drive signal based on the detected thickness of the article until the shredding operation is complete. The universal motor allows for reduced audible noise, lower energy consumption, and more efficient use of the motor.

When an induction motor is used, multiple motor windings may be switched according to the thickness of the at least one article being received by the throat (e.g., a two speed induction motor). In other words, the induction motor determines and adjusts a set of motor windings that are to be engaged based on the detected thickness of the article until the shredding is complete. The induction motor may also be pulsed like the universal motor. In one embodiment, different motor capacitors may be switched into the system to change the behavior of the motor. The induction motor allows for increased throughput, reduced audible noise, and increased gain efficiency of the motor.

When a Brushless DC (BLDC) motor is used, the speed of the motor is may be altered by changing the drive signal relative to the thickness of the at least one article being received by the throat (e.g., a pulse width modulation may be used). In other words, the BLDC motor adjusts the duty cycle and/or the control voltage based on the detected thickness of the article until the shredding is complete. The BLDC motor takes advantage of the speed-torque inverse relationship. The BLDC motor allows for energy savings, reduced audible noise, increased throughput, and the ability to "overdrive" the system.

When a DC motor is used, the duty cycle of the drive signal may be adjusted relative to the thickness' of the at least one article being received by the throat. In other words, the DC motor adjusts the motor speed based on the detected thickness of the article until the shredding is complete. In one embodiment, when the DC motor is used, the source voltage may be altered.

The foregoing illustrated embodiments have been provided to illustrate the structural and functional principles of the present invention and are not intended to be limiting. To the contrary, the present invention is intended to encompass all modifications, alterations and substitutions within the spirit and scope of the appended claims.

What is claimed is:

1. A shredder comprising:

a housing having a throat for receiving at least one article to be shredded;

a shredder mechanism received in the housing and including an electrically powered motor and cutter elements, the shredder mechanism enabling the at least one article to be shredded to be fed into the cutter elements and the motor being operable to drive the cutter elements so that the cutter elements shred the articles fed therein;

a detector positioned upstream of the electrically powered motor and cutter elements and configured to detect a thickness of the at least one article being received by the throat; and a controller coupled to the motor and the detector, the controller being configured to adjust an electrical power signal applied directly to the motor to vary running operation of the motor responsive to the detector detecting the thickness of the at least one article being received by the throat.

2. A shredder according to claim 1, wherein the controller is configured to adjust torque of the motor responsive to the detector detecting the thickness of the at least one article being received by the throat.

3. A shredder according to claim 1, wherein the controller is configured to adjust speed of the motor responsive to the detector detecting the thickness of the at least one article being received by the throat.

4. A shredder according to claim 1, wherein the controller is configured to prevent the motor from driving the cutter elements and to provide an alarm indication to alert a user responsive to the detector detecting that the thickness of the at least one article is greater than a predetermined maximum thickness threshold.

5. A shredder according to claim 4, wherein the alarm indication may include illuminating a visual indicator and/or sounding an audible alarm indicator.

6. A shredder according to claim 1, wherein the controller comprises a microcontroller.

7. A shredder according to claim 1, wherein the controller comprises a timer circuit.

8. A shredder according to claim 1, wherein the detector comprises a contact member that extends into the throat and is actuated in response to the article being inserted into the throat.

9. A shredder according to claim 1, wherein the controller is configured to continuously adjust the electrical power signal applied to the motor to vary running operation of the motor continuously responsive to the detector detecting a varying thickness of the at least one article being received by the throat.

10. A shredder according to claim 1, wherein the controller is configured to adjust the electrical power signal applied to the motor to vary running operation of the motor based on predefined discrete ranges of thicknesses responsive to the detector detecting the thickness of the at least one article being received by the throat.

11. A method for operating a shredder comprising a housing having a throat for receiving at least one article to be shredded, a thickness detector for detecting a thickness of the at least one article to be shredded inserted in the throat, and a shredder mechanism received in the housing and including an electrically powered motor and cutter elements, the shredder mechanism enabling the at least one article to be shredded to be fed into the cutter elements and the motor being operable drive the cutter elements in a shredding direction so that the cutter elements shred the articles fed therein and the detector positioned upstream of the electrically powered motor and cutter elements; the method comprising:

detecting with the thickness detector a thickness of the at least one article to be shredded inserted into the throat; and adjusting an electrical power signal applied directly to the electrically powered motor to vary running operation of the motor responsive to the detector detecting the thickness of the at least one article being received by the throat.

12. A method according to claim 11, wherein adjusting the electrical power signal applied to the motor to vary running operation of the motor comprises adjusting torque of the motor responsive to the detector detecting the thickness of the at least one article being received by the throat.

13. A method according to claim 11, wherein adjusting the electrical power signal applied to the motor to vary running operation of the motor comprises adjusting speed of the motor responsive to the detector detecting the thickness of the at least one article being received by the throat.

14. A method according to claim 11, further comprising preventing the motor from driving the cutter elements and providing an alarm indication to alert a user responsive to the detector detecting that the thickness of the at least one article is greater than a predetermined maximum thickness threshold.

15. A method according to claim 14, wherein the alarm indication may include illuminating a visual indicator and/or sounding an audible alarm indicator.

16. A method according to claim 11, wherein the controller comprises a microcontroller.

17. A method according to claim 11, wherein the controller comprises a timer circuit.

18. A method according to claim 11, wherein the detector comprises a contact member that extends into the throat and is actuated in response to the article being inserted into the throat.

19. A method according to claim 11, wherein the controller is configured to adjust the electrical power signal applied to the motor to vary running operation of the motor continuously responsive to the detector detecting a varying thickness of the at least one article being received by the throat.

20. A method according to claim 11, wherein the controller is configured to adjust the electrical power signal applied to the motor to vary running operation of the motor based on predefined discrete ranges of thicknesses responsive to the detector detecting the thickness of the at least one article being received by the throat.

21. A shredder according to claim 1, wherein the controller is further configured to vary running operation of the motor responsive to one or more determinations from the group consisting of: a detection by an auto-start sensor, a predetermined amount of time for the running operation of the motor, a speed of the motor, a torque of the motor, a duty cycle of the motor, and a voltage supplied to the motor.

22. A method according to claim 11, wherein the controller is further configured to vary running operation of the motor responsive to determining one or more determinations from the group consisting of: a detection by an auto-start sensor, a predetermined amount of time for the running operation of the motor, a speed of the motor, a torque of the motor, a duty cycle of the motor, and a voltage supplied to the motor.

23. A shredder according to claim 1, wherein the controller is configured to adjust an electrical power signal in a form of a duty cycle, current, or voltage that is applied to the motor to vary running operation of the motor responsive to the detector detecting the thickness of the at least one article being received by the throat.

24. A shredder according to claim 1, wherein the controller is configured to adjust the electrical power signal applied to the motor before the at least one article is shredded by the cutter elements of the shredder mechanism.

25. A method according to claim 11, further comprising adjusting an electrical power signal in a form of a duty cycle, current, or voltage that is applied to the motor to vary running operation of the motor responsive to the detector detecting the thickness of the at least one article being received by the throat.

26. A method according to claim 11, further comprising adjusting the electrical power signal applied to the motor before the at least one article is shredded by the cutter elements of the shredder mechanism.

* * * * *